US006798385B2

(12) United States Patent
Kirino

(10) Patent No.: US 6,798,385 B2
(45) Date of Patent: Sep. 28, 2004

(54) WIRELESS INFORMATION CONSUMER ELECTRONIC APPARATUS

(75) Inventor: Hideki Kirino, Kagawa (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 30 days.

(21) Appl. No.: 10/220,414

(22) PCT Filed: Feb. 28, 2001

(86) PCT No.: PCT/JP01/01493

§ 371 (c)(1),
(2), (4) Date: Dec. 6, 2002

(87) PCT Pub. No.: WO01/65633

PCT Pub. Date: Sep. 7, 2001

(65) Prior Publication Data

US 2003/0146875 A1 Aug. 7, 2003

(30) Foreign Application Priority Data

Mar. 2, 2000 (JP) ..... 2000-056809

(51) Int. Cl.[7] ..... H01Q 1/24
(52) U.S. Cl. ..... 343/702; 343/720; 343/850
(58) Field of Search ..... 343/702, 720, 343/846, 850, 893, 847, 848

(56) References Cited

U.S. PATENT DOCUMENTS 6,046,700 A * 4/2000 Kitchener et al. ..... 343/725
6,456,242 B1 * 9/2002 Crawford ..... 343/700 MS
2003/0028902 A1 * 2/2003 Cubley et al. ..... 725/151

FOREIGN PATENT DOCUMENTS

| | | |
|---|---|---|
| EP | 0929121 | 7/1999 |
| EP | 1078418 | 2/2001 |
| FR | 2779022 | 11/1999 |
| JP | 9-55679 | 2/1997 |

* cited by examiner

*Primary Examiner*—Shih-Chao Chen
(74) *Attorney, Agent, or Firm*—RatnerPrestia

(57) ABSTRACT

In the disclosed wireless information consumer electronics apparatus, limitation of mounting position of antenna is small, and further limitation of place of installation of the apparatus is small. Further, when stacking up a plurality of information consumer electronics apparatuses such as set-top boxes, the limitation of communication area and shortening of communication distance are small in this apparatus. A metal casing is used as a resonance antenna. Current is supplied through mounting screws, grounding wires connected in direct current, or an excitation patch coupled electromagnetically. Diversity action in plural excitation modes is also possible. The antenna can be matched automatically by using varactor diode or ferrodielectric capacitor.

13 Claims, 13 Drawing Sheets

R>>Re(Zant)

WIRELESS INFORMATION CONSUMER ELECTRONIC APPARATUS

THIS APPLICATION IS A U.S. NATIONAL PHASE APPLICATION OF PCT INTERNATIONAL APPLICATION PCT/JP01/01493.

TECHNICAL FIELD

The present invention relates to a consumer electronics apparatus for transmitting information by wireless means, and more particularly to an apparatus using a metal casing as an antenna.

BACKGROUND ART

It is recently attempted to use an information consumer electronics apparatus such as a set-top box by connecting to a network by wireless means:

A conventional example of wireless information consumer electronics apparatus is shown in FIG. 13 and FIG. 14. In the conventional wireless information consumer electronics apparatus shown in FIG. 13, an antenna 301 was used as an independent component. The antenna 301 was usually installed, for example, on the back side 302 of the apparatus or top 304 of the metal casing 303, because it must be installed in a place accessible to the space and not interfering the handling operation of the wireless information consumer electronics apparatus.

In the conventional method, however, if the antenna is installed in other places than the back side 302 of the apparatus or top 304 of the metal casing 303, depending on the direction of installation of the apparatus making communication, the following happens.

As shown in FIG. 14, even if transmitted and received waves of two apparatuses are in the same polarization plane, the reception power is lowered, and the antenna mounting position is limited.

Further, in the conventional method, when the antenna is installed at the position on the top 304 of the apparatus as shown in FIG. 13, the radiation directivity characteristic of the antenna is as shown directions 305, 306, and 307 in FIG. 14. Then the sensitivity is insufficient and the communication distance is short in the direction of 308. Consequently the position of installation of the apparatus is limited.

Besides, in the conventional method, when a plurality of information consumer electronics apparatuses such as set-top boxes are stacked up, the metal casing of each set-top box may impair the antenna characteristic of other set-top box, and the communication area is limited, or the communication distance is shortened.

DISCLOSURE OF INVENTION

Addressing to the problems, the wireless information consumer electronics apparatus of the invention comprises:

a) a metal casing used as an antenna, the metal casing being in a shape to resonate at the frequency being used,
b) a radio frequency module having a current feeding terminal for transmitting radio frequency signal or receiving radio frequency signal mounted on the outer surface of the casing, and
c) current feeding coupling means for feeding radio frequency current from the current feeding terminal to the outer surface of the metal casing through a mounting screw of the radio frequency module, and coupling the radio frequency module mechanically to the metal casing.

The wireless information consumer electronics apparatus in other aspect of the invention comprises:

a) a metal casing used as an antenna, the metal casing being in a shape to resonate at the frequency being used,
b) a radio frequency module installed inside the metal casing, and
c) means for feeding radio frequency current to the outer surface of the metal casing through a grounding wire of the radio frequency module connected in direct current to the metal casing and a current lead-out notch provided in the metal casing.

The wireless information consumer electronics apparatus in a different aspect of the invention comprises:

a) a metal casing used as an antenna, the metal casing being in a shape to resonate at the frequency being used,
b) a radio frequency module installed inside the metal casing, and
c) means for feeding radio frequency current to the outer surface of the metal casing through an excitation patch of the radio frequency module connected electromagnetically to the metal casing and a current lead-out window provided in the metal casing.

The wireless information consumer electronics apparatus in another aspect of the invention comprises:

a) a metal casing in a shape to resonate in plural modes at the frequency being used, and
b) means for feeding radio frequency current to the casing in plural excitation modes, so that the metal casing may operate in polarization and directivity diversity action.

The wireless information consumer electronics apparatus of the invention further comprises means for generating the plural excitation modes by selecting two or more grounding wires out of at least three or more grounding wires.

The wireless information consumer electronics apparatus of the invention further comprises means for generating the plural excitation modes by using plural resonance modes of the excitation patch.

The wireless information consumer electronics apparatus in a further aspect of the invention comprises:

a) a metal casing used as an antenna, and
b) an antenna automatic matching device for automatically detecting presence or absence of metal in the surroundings, or metal approaching state by monitoring the matching state of the antenna, and matching the antenna by varying the impedance of an antenna matching element automatically by a detection signal of the matching state.

In the wireless information consumer electronics apparatus of the invention, a varactor diode is used as the antenna matching element.

In the wireless information consumer electronics apparatus of the invention, a ferrodielectric capacitor is used as the antenna matching element.

According to the invention, by using a metal casing as an antenna, an independent component as antenna is not used, so that a wireless information consumer electronics apparatus not limited in the mounting position of antenna is realized.

According to the invention, a wireless information consumer electronics apparatus less limited in the place of installation of the apparatus is realized.

According to the invention, for example, even when stacking up a plurality of information consumer electronics apparatuses such as set-top boxes, the wireless information consumer electronics apparatus is less limited in the communication area and the communication distance is less shortened.

BEST MODE FOR CARRING OUT THE INVENTION (Embodiment 1)

Embodiment 1 of the invention is described in detail below while referring to FIG. 1 to FIG. 4.

Figure 1A:
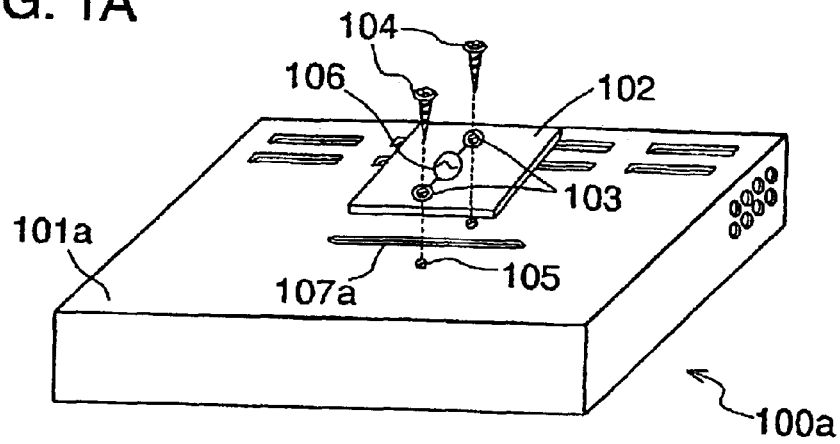
FIG. 1 is a perspective view of a wireless information consumer electronics apparatus such as a set-top box in embodiment 1 of the invention.
Figure 1B:
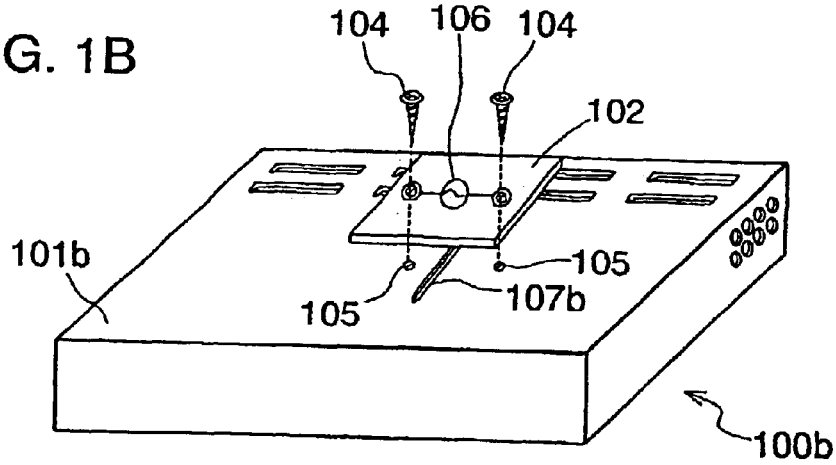
Figure 1C:
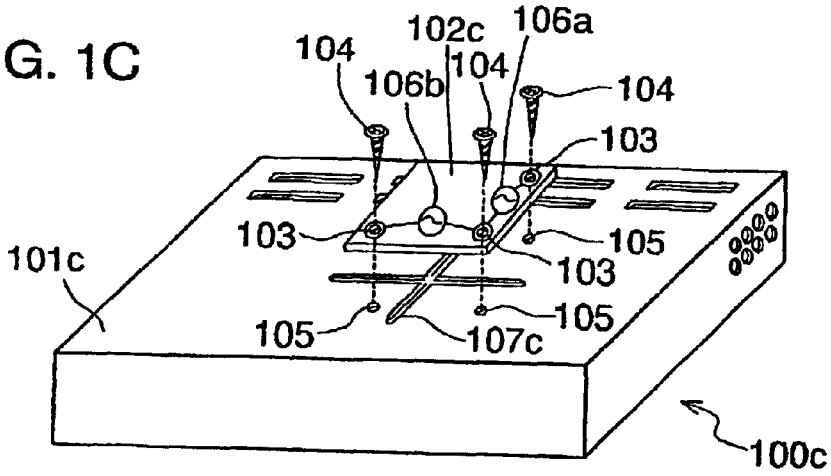
Figure 2:
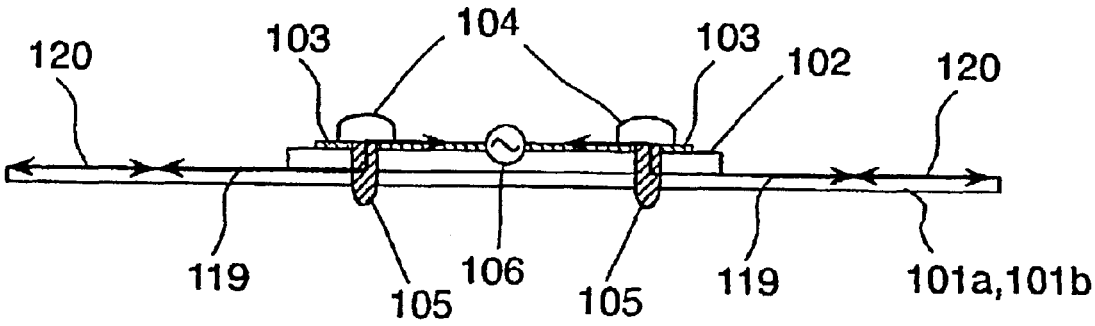
FIG. 2 is a sectional view showing flow of radio frequency current on the casing outer surface in embodiment 1 of the invention.

FIG. 1 is a perspective view of a wireless information consumer electronics apparatus such as a set-top box in embodiment 1 of the invention FIG. 2 is a sectional view showing flow of radio frequency current on the casing outer surface in embodiment 1 of the invention. FIG. 3 is a perspective view showing the direction of casing outer surface current and polarization and directivity characteristic when feeding current as shown in FIG. 1 at the central position of the casing when the casing size is 3λ/4 in width, 3λ/4 in depth, and λ/4 in height. FIG. 4 is a lateral sectional view showing the casing outer surface current and directivity characteristic when feeding current at the casing end position in the same casing size as in FIG. 3.

In FIG. 1, a wireless information consumer electronics apparatus 100*a* such as a set-top box has a metal casing 101*a*. The metal casing 101*a* has a shape to resonate at the frequency being used, and is designed to be used as an antenna. In FIG. 1A, a radio frequency module 102 is installed in the center of the top of the metal casing 101*a*, with its current feeding terminals 103 fitted into two screw holes 105 of the metal casing 101*a* by means of current feeding and mounting screws 104. The current feeding terminals 103 and metal casing 101*a* are electrically connected, and further the radio frequency module 102 is mechanically coupled to the metal casing 101*a* by means of the current feeding and mounting screws 104. This is also called the current feeding coupling means in the claims.

A signal source 106 is mounted on the radio frequency module 102, and a radio frequency current is applied from the current feeding terminals 103 to the metal casing 101*a*.

A slit 107*a* is opened between the two screw holes 105 so as to separate the two screw holes. This slit 107*a* is provided in the case that the distance between the current feeding terminals 103 is close to a distance electrically short-circuited in comparison with the wavelength of the radio frequency current and then the antenna radiation efficiency is not enough.

In the wireless information consumer electronics apparatus of the embodiment having such configuration, when a radio frequency signal is emitted as electromagnetic wave, the radio frequency signal is generated in the signal source 106 on the radio frequency module 102. The generated radio frequency signal flows as current on the outer surface of the metal casing 101*a*, through the current feeding and mounting screws 104, from the current feeding terminals 103 on the radio frequency module 102.

In FIG. 1B, the position of screw holes 105 are changed so as to vary the direction of the straight line linking the two current feed terminals 103 by 90 degrees when mounting the radio frequency module 102 on a metal casing 101*b*, as compared with FIG. 1A. The direction of a slit 107*b* is also varied by 90 degrees accordingly.

In FIG. 2, the radio frequency signal is generated in the signal source 106, and a radio frequency current 119 flows on the outer surface of metal casings 101*a*, 101*b* through current feeding terminals 103, current feeding and mounting screws 104, and screw holes 105 of metal casings.

Figure 3A:
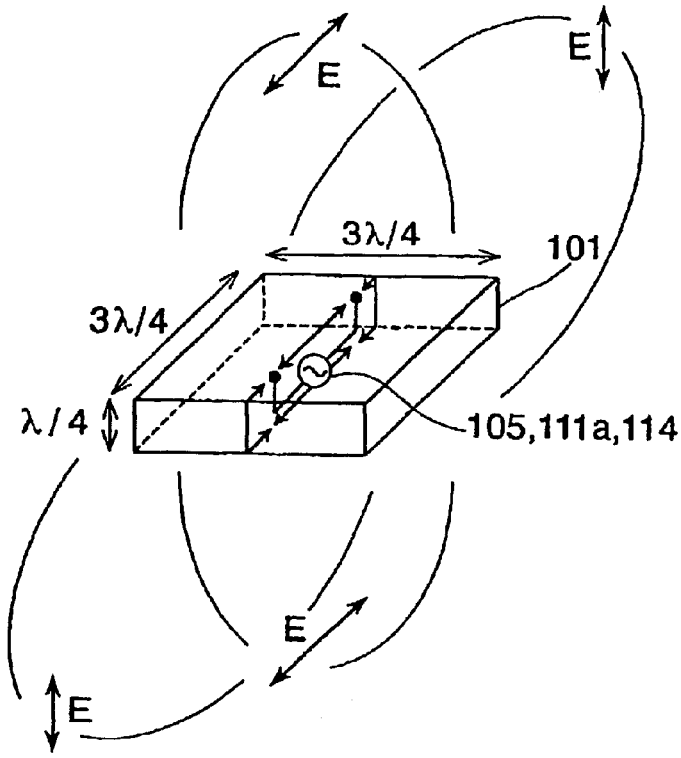
FIG. 3 is a perspective view showing the direction of casing outer surface current and polarization and directivity characteristic when feeding current as shown in FIG. 1 at the central position of the casing and the casing size is 3λ/4 in width, 3λ/4 in depth, and λ/4 in height.

The metal casings 101*a*, 101*b* are designed to resonate at the frequency being used when a radio frequency current flows on the casing outer surface of which size is, for example, 3λ/4 in width, 3λ/4 in depth, and λ/4 in height as shown in FIG. 3. The behavior of radio frequency current 119 flowing on the outer surface of the metal casing 101*a* composed as shown in FIG. 1A is shown in FIG. 3A. In FIG. 3A, the radio frequency current 119 resonates on the surface of the metal casing 101*a*, and generates a resonance current 120 on the casing outer surface as indicated by the arrow in the diagram and also shown in FIG. 2. In FIG. 3, one arrow represents a half wavelength of current on the casing, and the total of the casing outer circumference is two wavelengths. Thus it shows that the resonance current is flowing uniformly on the entire circumference of the casing.

Figure 3B:
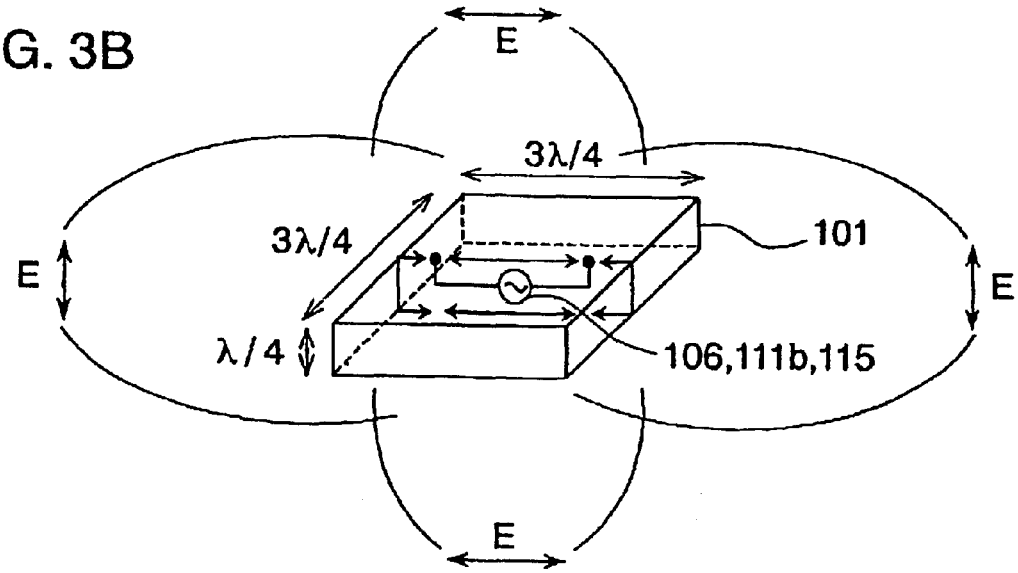
Figure 4:
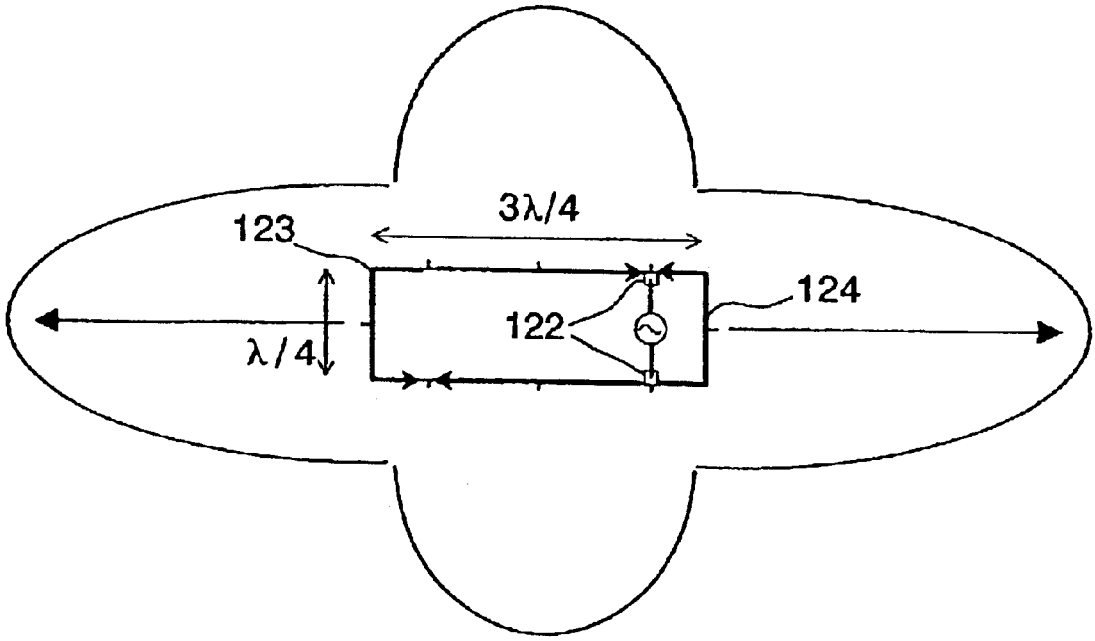
FIG. 4 is a lateral sectional view showing the casing outer surface current and directivity characteristic when feeding current at the casing end position in the same casing size as in FIG. 3.

In the case that the configuration is as shown in FIG. 1B, the flow of radio frequency current is as shown in FIG. 3B.

The radio frequency current 119 flowing on the casing outer surface and the resonance current 120 generated by the casing resonance are coupled with the space and hence radiate radio waves, so that the casing functions as an antenna.

Herein, the casing size is designed to resonate at the frequency being used. Therefore, as shown in FIG. 4, even if current is supplied from a position 122 on the casing, as the resonance current by resonance, a resonance current 124 closer to the current feeding position and a resonance current 123 remoter from the current feeding position are equal in magnitude. Accordingly the radiation directivity characteristic as the antenna is equal on both sides although the current feeding position is deviated to one side as shown in the diagram.

FIG. 1C shows a combination of configuration in FIG. 1A and configuration in FIG. 1B, in which a first signal source 106*a* and a second signal source 106*b* are mounted on a radio frequency module 102*c*. These two signal sources 106*a*, 106*b* are connected as shown in the diagram to three current feeding terminals 103 provided corresponding to three screw holes 105 disposed across each branch of a cross slit 107*c*.

Thus, by changing over two signal sources 106*a*, 106*b*, the radio frequency current can be generated individually as shown in FIG. 3A or FIG. 3B. Therefore, by changing over the planes of polarization of radio waves, radio waves can be generated in different modes (for example, different directions, or different polarizations such as vertical polarization, horizontal polarization, oblique polarization, right elliptical polarization or left elliptical polarization). Consequently the polarization and directivity characteristic bringing about a strong reception power for the destination of communication can be selected. In this case of changeover, only one signal source may be used, instead of two signal sources, and its connection to the current feeding terminals 103 can be changed over.

Besides, by operating two signal sources 106*a*, 106*b* simultaneously, radio waves of different modes can be generated at the same time Therefore it is easily applicable to the partner of communication. In case that even one signal source is used, the output can be divided into two by a radio frequency switch, so that it can be used in the same way as two signal sources. It therefore realizes a wireless information consumer electronics apparatus less limited in places for the apparatus to be installed.

According to the embodiment, so as to use the metal casing as an antenna, the metal casing is in a shape to resonate at the frequency being used. Then the radio frequency module is mounted on the outer surface of the metal casing, so that a radio frequency current may be supplied to the casing outer surface through the module mounting screws. In this configuration, a radio frequency current can be supplied on the metal casing outer surface. Besides, by the resonance of the metal casing, it can be used as an antenna having a favorable radiation characteristic at the opposite side of the current feeding position as well as at the same side. Since an independent component as antenna is not used, it realizes a wireless information consumer electronics apparatus free from limitation of antenna mounting position.

As explained in the embodiment, radio waves are generated from the signal source. In the same structure, however, by connecting a signal receiving unit, instead of the signal source, to the current feeding terminals, the metal casing as antenna also resonates by the radio wave transmitted from other devices because of reciprocity theorem, so that the radio wave is also received favorably. Therefore, the current feeding terminals in the invention are defined to be terminals which supply radio wave current to the outside, and terminals which supply radio frequency current also from the outside to the inside. The radio frequency module includes both a device which generates radio frequency signals, and a device which receives radio frequency signals.

(Embodiment 2)

Figure 5:
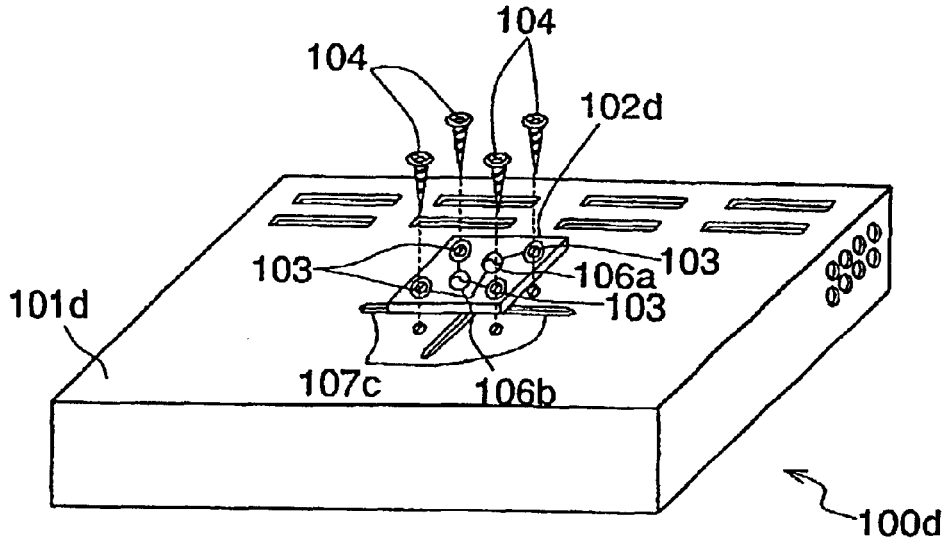
FIG. 5 is a perspective view of a wireless information consumer electronics apparatus such as a set-top box in embodiment 2 of the invention.

FIG. 5 is a perspective view showing a wireless information consumer electronics apparatus 100*d* such as a set-top box in embodiment 2 of the invention. What differs from FIG. 1C in embodiment 1 is the connection direction of signal sources 106*a*, 106*b* to the current feeding terminals 103 of a radio frequency module 102*d*. They are connected in diagonal directions to each one of four screw holes 105 around the cross slit 107*c*.

In this configuration, when the two signal sources are operated at the same time, radio frequency current flows as an X-form in the diagonal direction to a metal casing 101*d*, Therefore the planes of polarization of the radiated radio waves also correspond to this configuration. Along with such a change of flow of the radio frequency current, the dimensions of the metal casing is changed accordingly.

In embodiments 1 and 2, since the radio frequency module is mounted on the metal casing, it may be uneasy for another casing or other objects to be stacked up directly. To avoid this, by forming a recess including the radio wave module mounting positions and their peripheral portions of the metal casing, the radio wave module can be mounted in the recess. Moreover, when the upper surface of the radio frequency module is covered with nonconductive material such as plastic material, the radio frequency module can be protected, and invasion of dust can be prevented at the same time.

(Embodiment 3)

Figure 6:
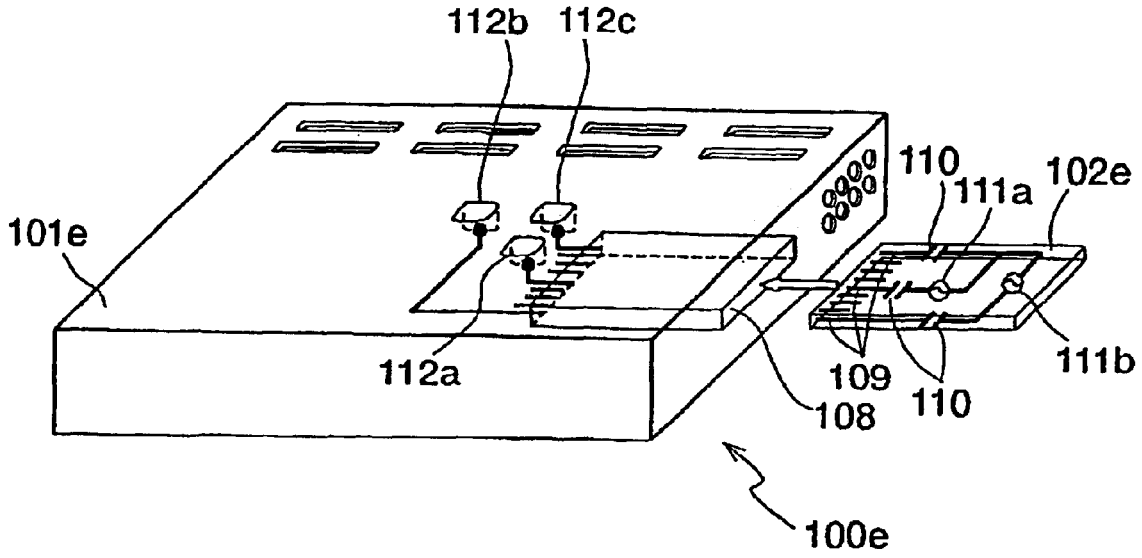
FIG. 6 is a perspective view of a wireless information consumer electronics apparatus such as a set-top box in embodiment 3 of the invention.
Figure 7:
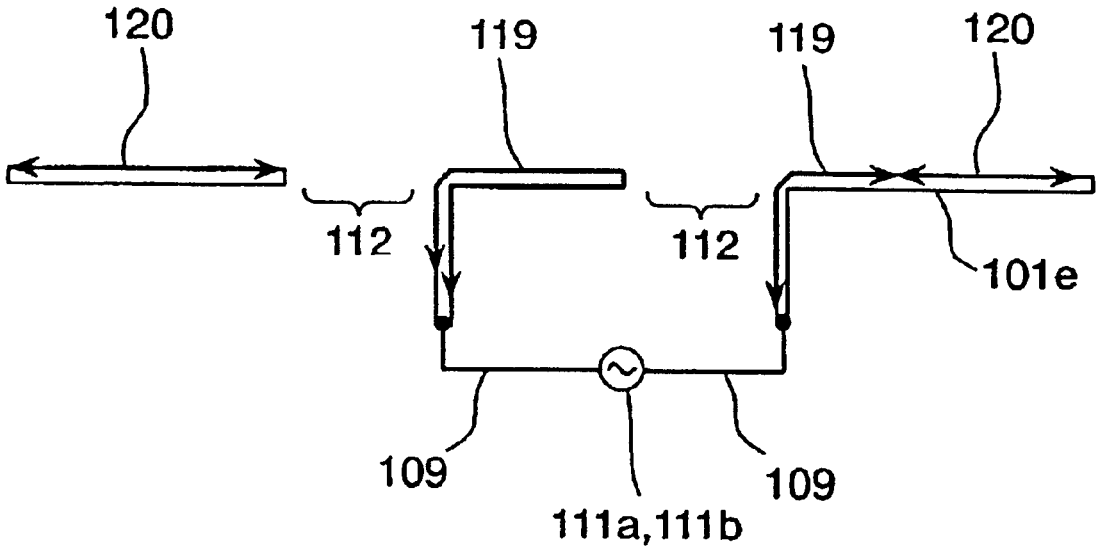
FIG. 7 is a sectional view showing flow of radio frequency current on the casing outer surface in embodiment 3.

FIG. 6 is a perspective view showing a wireless information consumer electronics apparatus 10*e* such as set-top box in embodiment 3 of the invention. FIG. 7 is a sectional view showing flow of radio frequency current on the casing outer surface. In FIG. 6, the apparatus 10*e* has a card-shaped radio frequency module 102*e* inserted in a side slot 108 of a metal casing 101*e*, and is connected to the connector. In the radio frequency module 102*e*, three grounding wires 109 are provided. A first signal source 111*a* and a second signal source 111*b* are connected in alternating current to the three grounding wires 109 by way of a capacitor 110. The grounding wires 109 are connected in direct current to radio frequency current lead-out notches 112*a* to 112*c* for leading out radio frequency current to the metal casing outer surface either directly or by way of a connector or the like.

In FIG. 6, the first signal source 111*a* is connected to the radio frequency current lead-out notch 112*a* through the capacitor 110 and grounding wire 109. The second signal source 111*b* is connected to the radio frequency current lead-out notch 112*b* through the capacitor 110 and grounding wire 109. The common output of the two signal sources is connected to the radio frequency current lead-out notch 112*c* through the capacitor 110 and grounding wire 109.

In the wireless information consumer electronics apparatus having such configuration, when radiating a radio frequency signal as an electromagnetic wave, the radio frequency signal is generated in the first signal source 111*a* and second signal source 111*b* on the card-shaped radio frequency module 102*e*. The generated radio frequency signal flows out as a current to the outer surface of the metal casing 101*e* through the grounding wires 109 connected in direct current to the metal casing and the radio frequency current lead-out notches 112*a* to 112*c*. Then the card-shaped radio frequency module 102*e* is inserted into the wireless information consumer electronics apparatus.

FIG. 7 shows the mode of flow of radio frequency current on the casing outer surface. In FIG. 7, the radio frequency signal generated in the first and second signal sources 111*a*,

111*b* flows as radio frequency current 119 on the outer surface of the metal casing 101*e*. Then the radio frequency current 119 flows through the grounding wires 109 connected in direct current to the metal casing and the radio frequency current lead-out notches 112*a* to 112*c*.

At this time, by the radio frequency current lead-out notches 112*a* and 112*c*, the radio frequency current as shown in FIG. 3A flows in the metal casing. By the radio frequency current lead-out notches 112*b* and 112*c*, the radio frequency current as shown in FIG. 3B flows in the metal casing.

In the embodiment, meanwhile, to prevent invasion of dust from the opening of the radio frequency current lead-out notches 112, the opening may be covered with a lid of nonconductive material such as plastic material.

(Embodiment 4)

Figure 8:
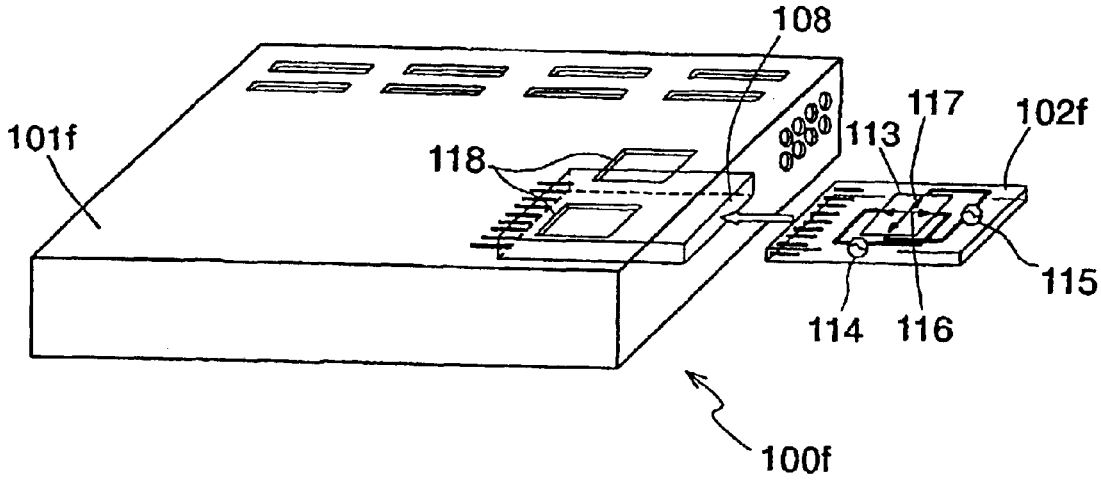
FIG. 8 is a perspective view of a wireless information consumer electronics apparatus such as a set-top box in embodiment 4 of the invention.
Figure 9:
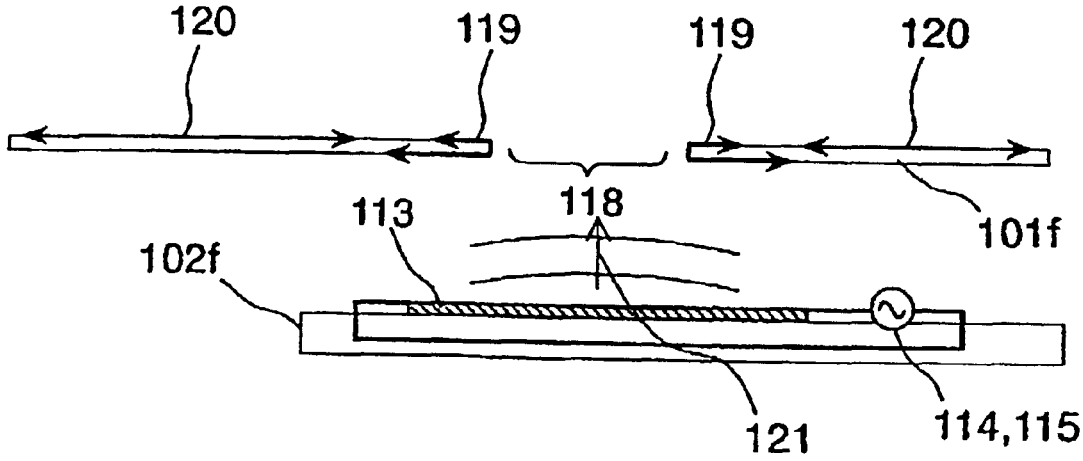
FIG. 9 is a sectional view showing flow of radio frequency current on the casing outer surface in embodiment 4.

FIG. 8 is a perspective view showing a wireless information consumer electronics apparatus 100*f* such as a set-top box in embodiment 4 of the invention. FIG. 9 is a sectional view showing flow of radio frequency current on the casing outer surface. In FIG. 8, the apparatus 100*f* has a card-shaped radio frequency module 102*f* inserted in the side of a metal casing 10 if, and is connected to the connector or the like. An excitation patch 113 is mounted on the radio frequency module 102*f*, and a first signal source 114 and a second signal source 115 are connected to the excitation patch 113. The metal casing 101*f* includes a lead-out window 118 for leading out the radio frequency current to the outer surface of the metal casing.

In the wireless information consumer electronics apparatus having such configuration, when radiating a radio frequency signal as an electromagnetic wave, the radio frequency signal is generated in the first signal source 114 and second signal source 115 on the card-shaped radio frequency module 102*f*. The generated radio frequency signal causes to generate a first resonance mode current 116 and a second resonance mode current 117 which cross orthogonally on the excitation patch 113. A radio frequency current flows to the outer surface of the metal casing, as the excitation patch 113 on the card-shaped radio frequency module 102*f* and the metal casing 101*f* are electromagnetically coupled. Then the card-shaped radio frequency module 102*f* is inserted into the apparatus 100*f*. The flowing radio frequency current flows out to the casing outer surface through the radio frequency current lead-out window 118.

FIG. 9 shows the mode of flow of radio frequency current on the casing outer surface. In FIG. 9, the radio frequency signal generated in the first and second signal sources 114, 115 is applied at right angle into the excitation patch 113 having plural resonance modes. A radiation 121 from the excitation patch 113 electromagnetically coupled to the metal casing 101*f* passes through the radio frequency current lead-out window 118 in plural excitation modes. Thus a radio frequency current 119 flows on the outer surface of the metal casing 101.

The metal casing 101*f* is designed, so as to resonate at the frequency being used when the radio frequency current flows on the casing outer surface, in the size of, for example, $3\lambda/4$ in width, $3\lambda/4$ in depth, and $\lambda/4$ in height as shown in FIG. 3. The radio frequency current 119 flowing on the outer surface of the metal casing 101*f* having such a structure resonates on the casing surface. The current 119 generates a resonance current 120 on the casing outer surface shown in FIG. 9, in the same manner as indicated by arrow in FIG. 3. In FIG. 3, one arrow represents a half wavelength of current on the casing, and the total of the casing outer circumference is two wavelengths, and it shows that the resonance current is flowing uniformly on the entire circumference of the casing.

The radio frequency current 119 flowing on the casing outer surface and the resonance current 120 generated by the casing resonance are coupled with the space and hence radiate radio waves, so that the casing functions as an antenna.

In the embodiment, meanwhile, to prevent invasion of dust from the opening of the radio frequency current lead-out window 118, the opening may be covered with a lid of nonconductive material such as plastic material.

In the foregoing embodiments 3 and 4, the location of radio frequency current lead-out notches and radio frequency current lead-out window to the metal casing, and the dimensions of the metal casing may be properly changed. By making these changes, a resonance state may be established by passing radio frequency current in the diagonal direction of the metal casing as shown in embodiment 2.

In embodiments 3 and 4, the radio frequency module is a card that can be inserted into the metal casing and pulled out from that, but the radio frequency module may be also fixed in the metal casing.

In embodiments 2, 3 and 4, as explained by referring to FIG. 4, the metal casing is shaped so as to resonate, and an independent component as antenna is not used, so that a wireless information consumer electronics apparatus not limited in the mounting position of antenna is realized.

In embodiments 2, 3 and 4, as explained in embodiment 1, by changing over the signal source in the direction for feeding current to the metal casing used as antenna, the polarization and directivity characteristic can be changed over as shown in FIGS. 3A, B. This is in the same manner when changed over so as to operate either the first signal source 106*a*, 111*a*, 114, or the second signal source 106*b*, 111*b*, 115. Hence, depending on an apparatus, the polarization and directivity characteristic being strong in the reception power can be selected. Accordingly a wireless information consumer electronics apparatus less limited in the place of installation of the apparatus is realized.

Thus, according to the invention, as one method, in a structure using metal casing as antenna, the following configuration is employed. i) The metal casing is shaped so as to resonate at the frequency being used ii) a radio frequency module is put on the outer surface of the metal casing, and iii) a radio frequency current is supplied to the casing outer surface through the module mounting screws. As a result, a radio frequency current can be supplied to the outer surface of the metal casing, and by the resonance of the casing, it can be used as an antenna having uniform and excellent radiation characteristic regardless of the current feeding position on the casing. Since an independent component as antenna is not used, a wireless information consumer electronics apparatus not limited in the mounting position of antenna is realized.

This effect is also realized by shaping the metal casing so as to resonate at the frequency being used, placing a radio frequency module in the casing, and feeding radio frequency current to the casing through the grounding wire connected in direct current to the casing.

Further, the same effect is realized by shaping the metal casing so as to resonate at the frequency being used, placing a radio frequency module in the casing, and feeding radio frequency current to the casing through the excitation patch electromagnetically connected to the casing.

According to the invention, in the structure of using metal casing as antenna, the metal casing is shaped so as to resonate in plural modes at the frequency being used, and a radio frequency current can be supplied to the casing in plural excitation modes so that the casing may operate in polarization and directivity diversity action.

Selecting two or more grounding wires out of at least three or more grounding wires can generate the plural excitation modes.

Or, the plural excitation modes can be generated by using plural resonance modes of the excitation patch, and electromagnetic waves of different polarizations and electromagnetic waves of different directivity characteristics can be generated from the metal casing.

Thus, in the apparatus, the polarization and directivity characteristic being strong in the reception power can be selected, so that a wireless information consumer electronics apparatus less limited in the place of installation of the apparatus is realized.

(Embodiment 5)

Figure 10:
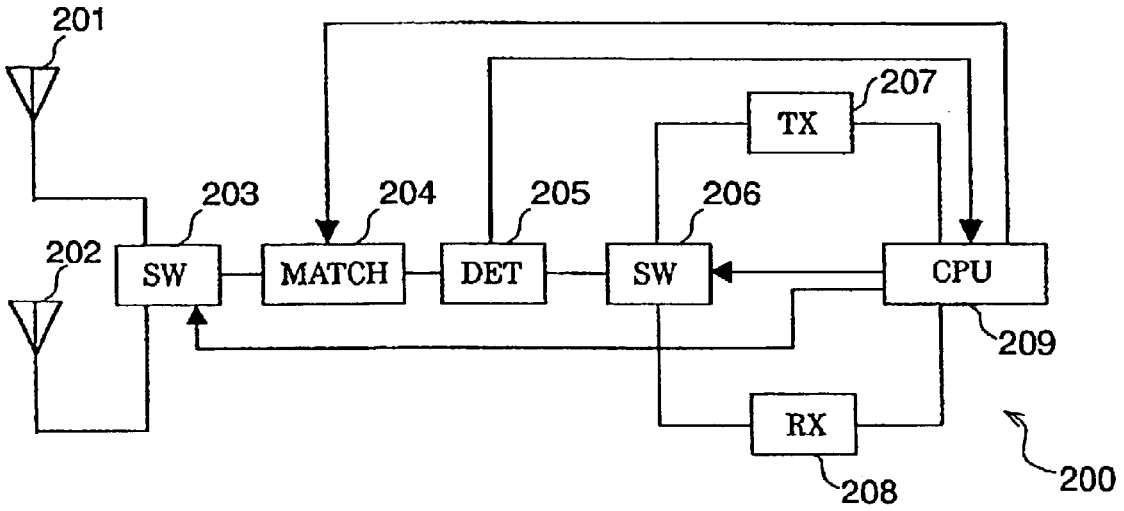
FIG. 10 is a block diagram of a wireless information consumer electronics apparatus in embodiment 5 of the invention.
Figure 11:
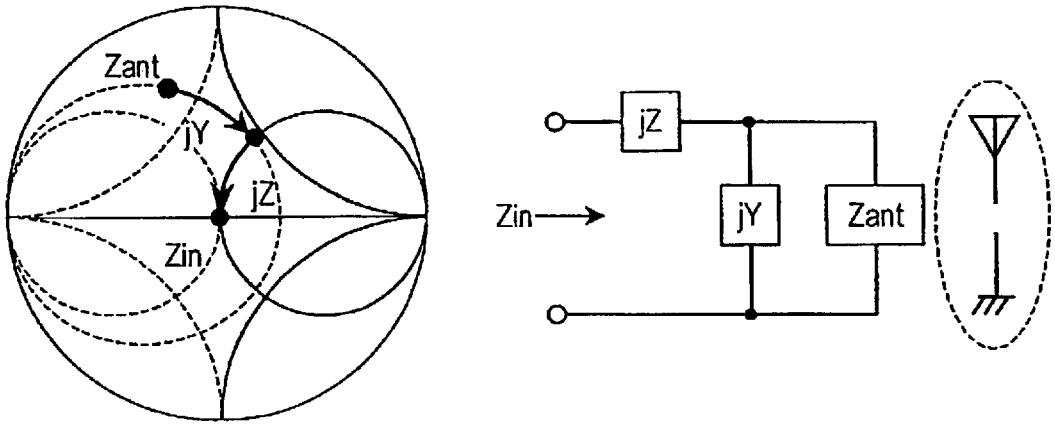
FIG. 11 is a diagram showing a matching method of antenna of the wireless information consumer electronics apparatus in embodiment 5 of the invention.

Embodiment 5 of the invention is described below while referring to FIG. 10 to FIG. 12. FIG. 10 is a block diagram of a wireless information consumer electronics apparatus in embodiment 5 of the invention FIG. 11 is a diagram showing a matching method of the wireless information consumer electronics apparatus in embodiment 5 of the invention, FIGS. 12A, B are circuit diagrams showing configuration of matching element of the wireless information consumer electronics apparatus in embodiment 5 of the invention. FIG. 12C is a diagram showing reactance characteristic of matching element of the wireless information consumer electronics apparatus in embodiment 5 of the invention.

This embodiment is applied in a wireless information consumer electronics apparatus using metal casing as antenna as shown in embodiments 1 to 4.

In a wireless information consumer electronics apparatus 200 in FIG. 10, a metal casing antenna 201 operating on the first polarization and directivity, and a metal casing antenna 202 operating on the second polarization and directivity are selectively changed over by an antenna switch 203, and connected to a matching circuit 204. The matching circuit 204 is also called as an antenna automatic matching device in the claims for matching the antenna by varying the impedance of the antenna matching element automatically by a detection signal of antenna matching state.

A matching state monitoring circuit 205 is, as described in the claims, for automatically detecting the presence or absence of metal in the surroundings or metal approaching state by monitoring the matching state of the antenna in the structure of using metal casing as antenna.

A transmission-reception changeover switch 206 selectively changes over whether to connect a transmission signal from a transmission circuit 207 to the antenna side circuit, or to connect a reception signal from the antenna side circuit to a reception circuit 208. A CPU 209 controls the operation of this wireless information consumer electronics apparatus.

In FIG. 10, the wireless information consumer electronics apparatus 200 detects the matching state of the antenna by the matching state monitoring circuit 205, for example, in a pause of transmission timing of data packet. For the detection, for example, a directivity coupler and a detecting element are used, and transmission power toward the matching circuit 204 and reflection power reflected from the matching circuit 204 are detected, and digitized and sent into the CPU 209.

Suppose the reflection amount and transmission loss of input and output terminals of the antenna switch 203, matching state monitoring circuit 205, and transmission-reception changeover switch 206 are designed sufficiently small. Then the reflection power reflected from the matching circuit 204 is determined by the relation between the combined impedance of the antenna 201 or 202 and matching circuit 204 and the output impedance of the transmission circuit 207.

The matching state data detected by the matching state monitoring circuit 205 is sent into the CPU 209. The CPU sends the matching data into the matching circuit 204 for matching. In the matching circuit 204, from the matching data received from the CPU, a control voltage for matching is generated.

FIG. 11 shows an antenna matching method. In the diagram, antenna impedance Zant is matched with impedance Zin of transmission circuit 207 side, for example, at parallel admittance (a reciprocal number of impedance) jY and series impedance jZ. In the diagram, the mode of impedance matching at Jy and jZ is shown on the immittance chart.

Figure 12A:
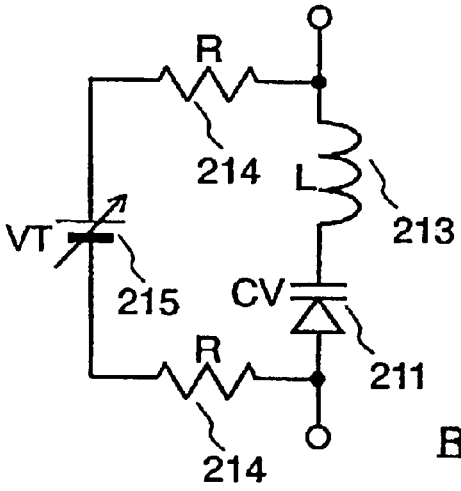
FIGS. 12A, B are circuit diagrams showing configuration of matching element of the wireless information consumer electronics apparatus in embodiment 5 of the invention.

FIG. 12A and B show the composition of matching element. FIG. 12C shows the reactance characteristic of the matching element.

As the matching element, which varies in impedance depending on control voltage, for example, a circuit using a varactor diode 211 indicated by CV in FIG. 12A may be used. This varactor diode 211 is a varactor diode for composing the automatic matching device or automatic matching element, as also mentioned in the claims.

Figure 12B:
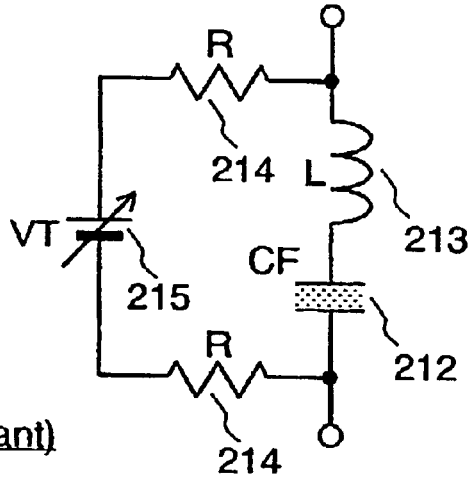
FIG. 12C is a diagram showing reactance characteristic of matching element of the wireless information consumer electronics apparatus in embodiment 5 of the invention.
Figure 12C:
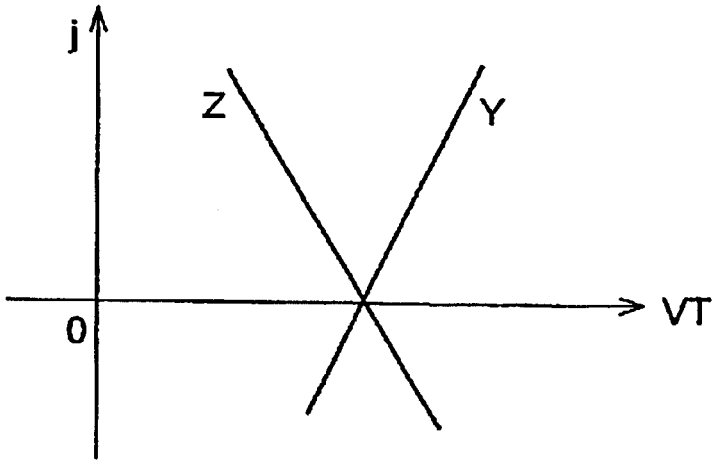
Figure 13A:
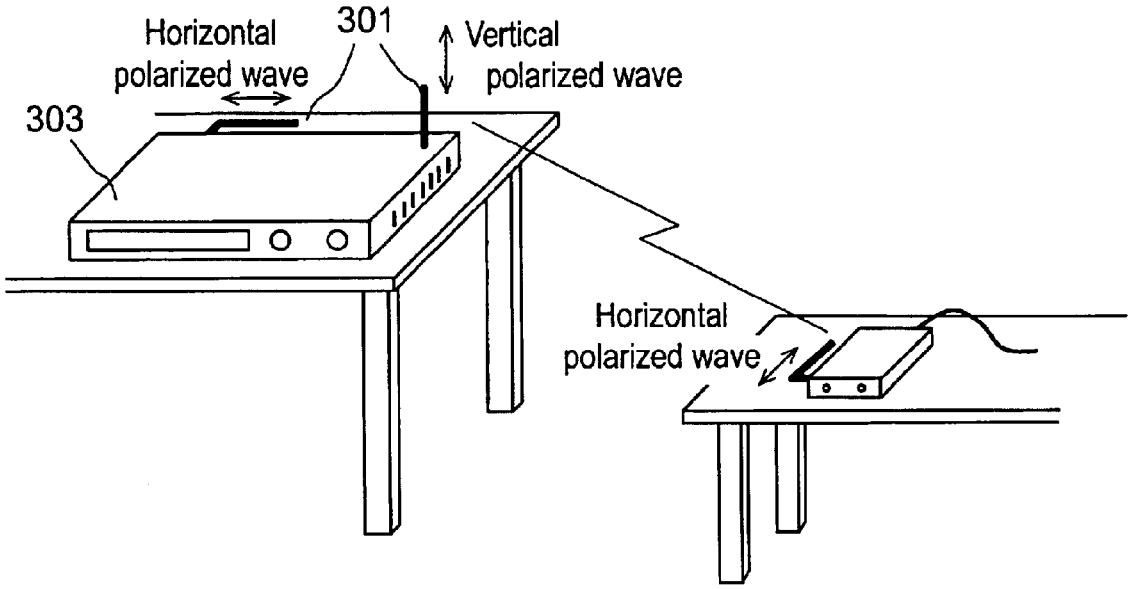
FIG. 13A PRIOR ART
FIG. 13 is a diagram showing a conventional wireless information consumer electronics apparatus.
Figure 13B:
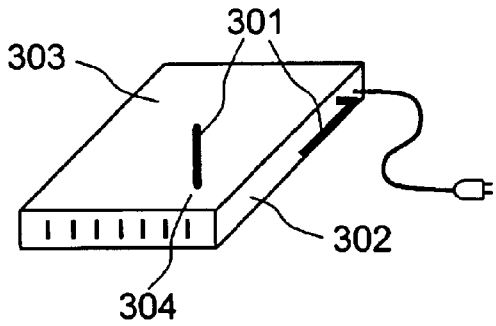
FIG. 13B PRIOR ART
Figure 14:
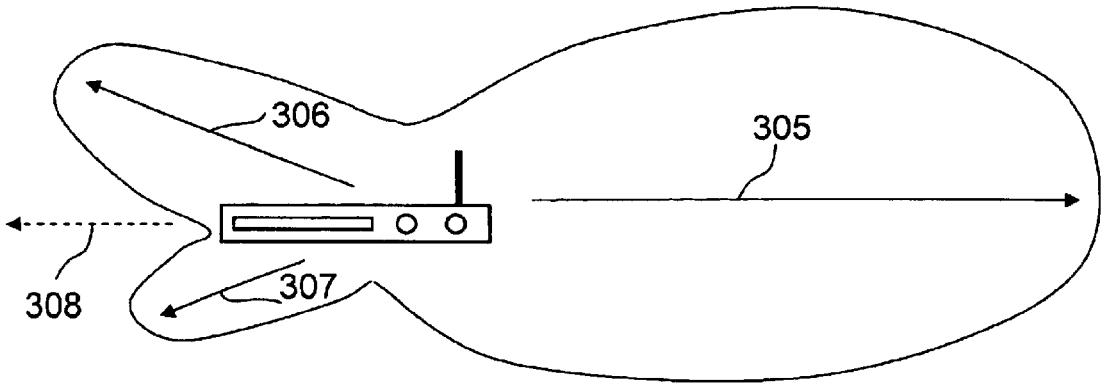
FIG. 14 PRIOR ART
FIG. 14 is a diagram showing antenna directivity characteristic of the conventional wireless information consumer electronics apparatus.

Alternatively, a circuit using ferrodielectric capacitor 212 indicated by CF in FIG. 12B may be used. This ferrodielectric capacitor 212 is a ferrodielectric capacitor for also composing the automatic matching device mentioned in the claims.

For example, if selecting as R>>Re (Zant) as shown in the diagram, the impedance Z and admittance Y between the matching element terminals vary in a range from capacitive state to inductive state as shown in FIG. 12C by the control voltage 215 indicated by VT. Therefore by connecting this matching element to the antenna as parallel admittance and series impedance shown in FIG. 11, antenna matching is realized.

Herein, since the antenna matching state varies significantly depending on the presence or absence of metal around the antenna or metal approaching state. Conversely, by monitoring the antenna matching state, presence or absence of metal around the antenna or metal approaching state can be automatically detected. The presence of metal around the antenna or metal approaching may vary the antenna impedance and impair the radiation performance. By matching the antenna again when the antenna impedance is changed, the worsened radiation performance may be recovered Therefore, in the conventional method, for example, when stacking up a plurality of set-top boxes or other information consumer electronics apparatuses, the metal casing of each set-top box acts to worsen the antenna radiation characteristic of other set-top boxes. Consequently the communication area is limited or the communication distance is shortened. According to the invention, by matching the antenna again when the antenna impedance is changed after once detecting the antenna matching state, the worsened radiation performance may be recovered. As a result, limitation of place of installation of the apparatus is alleviated, and even in a stack-up installation of apparatuses, a wireless information consumer electronics apparatus not worsened in the antenna sensitivity is realized.

As explained herein, only the plural modes of the casing has as the polarization diversity are used, but it is also possible to use the methods explained by combining them with a conventional independent component as antenna such as dielectric chip antenna.

Even if the metal casing inevitably cannot be shaped so as to resonate at the frequency being used, by automatically matching the antenna, the antenna efficiency is enhanced. In other words, even if the metal casing is not preliminarily designed to resonate at the frequency being used, only by installing a radio frequency module at an arbitrary place, a wireless information consumer electronics apparatus having an efficient antenna may be realized.

INDUSTRIAL APPLICABILITY

According to the wireless information consumer electronics apparatus of the invention, as described herein, the following constitution is employed to use the metal casing as an antenna.

a) the metal casing is in a shape to resonate at the frequency being used, and
b) the radio frequency module is mounted on the casing outer surface, so that a radio frequency current may be supplied to the casing outer surface through the module mounting screws.

Then, since an independent component as antenna is not used, it realizes a wireless information consumer electronics apparatus free from limitation of antenna mounting position.

The same effects are also obtained by:

a) forming the metal casing so as to resonate at the frequency being used,
b) putting the radio frequency module in the casing, and
c) supplying radio frequency current to the casing outer surface through the grounding wire connected in direct current to the casing and the current lead-out notch provided in the casing.

Also the same effects are obtained by:

a) forming the metal casing so as to resonate at the frequency being used,
b) putting the radio frequency module in the casing, and
c) supplying radio frequency current to the casing outer surface through the excitation patch electromagnetically coupled to the casing and the current lead-out window provided in the casing.

Further, according to the wireless information consumer electronics apparatus of the invention, in the structure of using metal casing as antenna, the metal casing is shaped so as to resonate in plural modes at the frequency being used. Then a radio frequency current can be supplied to the casing in plural excitation modes so that the casing may operate in polarization and directivity diversity action. Thus a wireless information consumer electronics apparatus less limited in a place of installation of the apparatus is realized.

The plural excitation modes can be generated by selecting two or more grounding wires out of at least three or more grounding wires. Then the same effects are obtained.

Further, the plural excitation modes can be generated by using plural resonance modes of the excitation patch. Then, the same effects are obtained as well.

In the wireless information consumer electronics apparatus of the invention, having the structure of using metal casing as antenna, by monitoring the matching state of the antenna, presence or absence of metal around the apparatus or metal approaching state can be detected automatically. Besides the antenna is matched by varying the impedance of the antenna matching element automatically by this detection signal.

Therefore, for example, when stacking up a plurality of information consumer electronics apparatuses such as set-top boxes, a wireless information consumer electronics apparatus less limited in their communication area and less shortened in their communication distance is realized.

The same effects are obtained by using a varactor diode as the antenna matching element.

Also, the same effects are obtained by using a ferrodielectric capacitor as the antenna matching element.

Even if the metal casing inevitably cannot be shaped so as to resonate at the frequency being used, by matching the antenna automatically, the antenna efficiency can be enhanced. In other words, if the metal casing is not designed preliminarily in a shape to resonate at the frequency being used, only by mounting a radio frequency module at an arbitrary place, a wireless information consumer electronics apparatus having an efficient antenna is realized. This is the greatest merit of the invention.

What is claimed is:

1. A wireless information consumer electronics apparatus comprising:

a metal casing used as an antenna, in a shape to resonate at a frequency being used, a radio frequency module having a current feeding terminal for transmitting or receiving a radio frequency signal mounted on an outer surface of said metal casing, and current feeding coupling means for connecting a current feeding terminal of said radio frequency module electrically to said metal casing, and coupling said radio frequency module mechanically to said metal casing, wherein a radio frequency current is supplied to the outer surface of said metal casing by said current feeding coupling means.

2. A wireless information consumer electronics apparatus comprising:

a metal casing used as an antenna, in a shape to resonate at a frequency being used, a radio frequency module installed inside said metal casing, and having a current feeding terminal for transmitting or receiving a radio frequency signal, being connected at high frequency to a grounding wire connected in direct current to said metal casing, and a current lead-out notch provided in said metal casing, and connected to a grounding wire of said radio frequency module, wherein a radio frequency current is supplied to an outer surface of said metal casing through said current lead-out notch.

3. A wireless information consumer electronics apparatus comprising:

a metal casing in a shape to resonate at a frequency being used, having a current lead-out window and used as an antenna, and a radio frequency module installed inside said metal casing, having an excitation patch electromagnetically coupled to said casing as an input and an output of radio frequency current to be transmitted or received, wherein the radio frequency current is supplied to an outer surface of said metal casing through the excitation patch of said radio frequency module and the current lead-out window of said metal casing.

4. The wireless information consumer electronics apparatus of claim 1, wherein said metal casing is designed in a shape to resonate in plural modes at the frequency being used, and the radio frequency current is supplied to said metal casing in plural excitation modes, so that said metal casing may operate in polarization and directivity diversity action.

5. The wireless information consumer electronics apparatus of claim 2, wherein said metal casing is designed in a shape to resonate in plural modes at the frequency being used, and the radio frequency current is supplied to said metal casing in plural excitation modes, so that said metal casing may operate in polarization and directivity diversity action, and the plural excitation modes are generated by selecting two or more grounding wires out of at least three or more grounding wires.

6. The wireless information consumer electronics apparatus of claim 3, wherein said metal casing is designed in a shape to resonate in plural modes at the frequency being used, and the radio frequency current is supplied to the casing in plural excitation modes, so that said metal casing may operate in polarization and directivity diversity action, and plural excitation modes are generated by using plural resonance modes of the excitation patch.

7. The wireless information consumer electronics apparatus of claim 1, wherein said metal casing further comprising an antenna automatic matching device for detecting whether a metal presents in the surroundings or a metal approaching state automatically by monitoring a matching state of the antenna, and matching the antenna by varying an impedance of an antenna matching element automatically by a detection signal of the matching state.

8. The wireless information consumer electronics apparatus of claim 7, wherein a varactor diode is used as said antenna matching element.

9. The wireless information consumer electronics apparatus of claim 7, wherein a ferrodielectric capacitor is used as said antenna matching element.

10. The wireless information consumer electronics apparatus of claim 2, wherein said metal casing is designed in a shape to resonate in plural modes at the frequency being used, and the radio frequency current is supplied to said metal casing in plural excitation modes, so that said metal casing operates in polarization and directivity diversity action.

11. The wireless information consumer electronics apparatus of claim 3, wherein said metal casing designed in a shape to resonate in plural modes at the frequency being used, and the radio frequency current is supplied to said metal casing in plural excitation modes, so that said metal casing operates in polarization and directivity diversity action.

12. The wireless information consumer electronics apparatus of claim 2, wherein said metal casing further comprising an antenna automatic matching device for detecting whether a metal presents in the surroundings or a metal approaching state automatically by monitoring a matching state of the antenna, and matching the antenna by varying an impedance of an antenna matching element automatically by a detection signal of the matching state.

13. The wireless information consumer electronics apparatus of claim 3, wherein said metal casing further comprising an antenna automatic matching device for detecting whether a metal presents in the surroundings or a metal approaching state automatically by monitoring a matching state of the antenna, and matching the antenna by varying an impedance of an antenna matching element automatically by a detection signal of the matching state.

* * * * *

UNITED STATES PATENT AND TRADEMARK OFFICE

CERTIFICATE OF CORRECTION

PATENT NO. : 6,798,385 B2
DATED : September 28, 2004
INVENTOR(S) : Hideki Kirino It is certified that error appears in the above-identified patent and that said Letters Patent is hereby corrected as shown below:

Column 14,
Line 9, after "casing" insert -- is --

Signed and Sealed this

Nineteenth Day of April, 2005

JON W. DUDAS
*Director of the United States Patent and Trademark Office*